US005632655A

United States Patent [19]

DeMarco, Jr.

[11] Patent Number: 5,632,655

[45] Date of Patent: May 27, 1997

[54] ELECTRICAL CONNECTOR WITH REPLACEABLE MALE PINS

[75] Inventor: James S. DeMarco, Jr., Waterford, Conn.

[73] Assignee: The United States of America as represented by the Secretary of the Navy, Washington, D.C.

[21] Appl. No.: 408,674

[22] Filed: Mar. 20, 1995

[51] Int. Cl.[6] ..... H01R 25/00

[52] U.S. Cl. ..... 439/655; 439/819; 439/598

[58] Field of Search ..... 439/816, 819, 439/823, 824, 825, 700, 654, 655, 891, 739, 744–747, 733, 598, 271, 596

[56] References Cited

U.S. PATENT DOCUMENTS

| | | | |
|---|---|---|---|
| 3,052,867 | 9/1962 | Rogoff | 439/823 |
| 3,170,752 | 2/1965 | Van Horssen | 439/891 |
| 3,210,720 | 10/1965 | Harris, Jr. | 439/891 |
| 4,904,208 | 2/1990 | Powell et al. | 439/654 |
| 5,399,110 | 3/1995 | Morello et al. | 439/891 |

*Primary Examiner*—David Pirlot

*Attorney, Agent, or Firm*—Michael J. McGowan; Prithvi C. Lall; Michael F. Oglo

[57] ABSTRACT

An electrical connector includes a first female insert having pin engagable sockets and a second female insert having pin engagable sockets. The first insert is in electrical connection with the second insert. The socket inserts are connected via connector pins which are configured to fit within the sockets and between the socket members. The connector pins function to electrically connect the socket inserts and may include a locking extension for locking the pins in the sockets of the female inserts. The connector may also include a protective disk disposed between the socket inserts which envelopes the connector pins and protects them from damage.

19 Claims, 3 Drawing Sheets

10
12
14
16
18
20
22
24
25
26
27
28
29a
29b
34
36
38
40
50
52
54
56
116
118
128
160
162
164

ELECTRICAL CONNECTOR WITH REPLACEABLE MALE PINS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to electrical connectors, and more particularly, to a disassemblable electrical connector having replaceable parts.

(2) Description of the Prior Art

Electrical connectors are used for electrically connecting power sources or the like to apparatuses or devices requiring power for their operation. Electrical connectors are also used for transmitting electrical signals between monitoring devices and machinery or the like for monitoring the performance of the machinery. Electrical connectors can also be used for a variety of other applications simply requiring the exchange of electrical transmissions.

Of particular interest with regard to the instant invention, are electrical connectors used for connecting underwater array modules. Generally, such electrical connectors are located forward and aft of each array module or tow cable termination. Prior art electrical connectors which are used for underwater array modules, generally consist of two major parts. These parts include a male connector insert and a female connector insert wherein the male connector insert includes pins engagable with sockets of the female connector insert. Generally, one male connector insert is brought together with one female connector insert and engaged for forming a complete electrical connection between array modules or tow cables and array modules. Typically, during numerous cycles of connecting and disconnecting the connector inserts comprising the electrical connector, the pins of the male insert tend to weaken from wear, bending thereof and eventually break off. Such failure of the pins of the male insert tends to occur even when using mechanical keys or the like for aligning and guiding the inserts into the mating arrangement.

Currently, once the pins of the male insert break off, the only method of repair is to disassemble the underwater array and replace the entire male connector insert. Obviously, such repair work must take place which entails time consuming, laborious, sometimes hazardous and frequently expensive manual labor. Therefore, there exists a need for an electrical connector for simplifying disassembly and replacement of broken parts which decreases cost, danger, and shut down time. The prior art includes several connectors having disassemblable designs but none of which are particularly suitable and convenient for troublesome applications such as with underwater electrical connections.

U.S. Pat. No. 3,054,078 to Baschkin discloses an intermediate panel connector. The electrical connector assembly includes a pair of panels each having a plurality of electrical contacts. The contacts of one panel are adapted to mate with contacts of the other panel via a junction connector. The junction connector has an electrically conductive base with first and second sets of contacts located on opposing sides of the conductive base. The first set of contacts is adapted to mate with a group of contacts in one of the panels and the other set of contacts is adapted to mate with a group of contacts in the other panel. With the junction connector installed, the contacts of each panel are electrically joined. The junction connector in Baschkin does not include means for locking the junction connector to the sockets or the like in either the electrical panels or the junction connector itself. In addition, the panels are physically connected via separate fasteners structurally distinct from the junction connectors. The panel connector in Baschkin would be cumbersome for underwater use, requiring the steps of both inserting the junction connectors and securing the panels together for installation. If damage occurred to one of the pins or sockets comprising the junction connector, the entire junction connector would have to be disposed of. Because the panel connectors use several differently designed connectors for connecting one set of panels, a repair technician would have to carry each type of junction connector in order to repair the connector, making installation or repair more difficult.

U.S. Pat. No. 3,382,475 to Kramer discloses a cable connector adapter particularly adapted for use in testing missile systems. The adapter is designed for use with a typical pin and plug type connector assembly. The adapter is used between the pin and plug portions of the connector so as to selectively connect and/or disconnect particular electrical conductors comprising the pin and plug halves, thereby selectively transmitting electrical signals to the missile circuit. The adapter includes a sleeve and a pin insert adapted to selectively engage removable pins in a plurality of cavities comprising the insert. The sleeve and insert are adapted for placement between the pin and plug connectors. In accordance with parameters to be tested, selected pins are installed or removed from the pin insert. The missile is monitored for its reaction to various scenarios provided by the pin connections and non-connections. While Kramer includes removable pins for selectively connecting certain conductors with certain elements of the pre-installed circuit of the missile, the pins are not specifically designed to both structurally and electrically connect the cable and circuit. Further, the pins include no means for being locked within the sockets of either the cable connector.

U.S. Pat. No. 4,653,839 to Powell discloses a connector comprising a male pin connector half and a female socket connector half having removable socket elements, which is particularly useful in hostile environments wherein the sockets require frequent cleaning. The male half includes a plurality of pins extending outwardly for engagement with the female sockets. A group of socket modules are provided that can each receive one of the pin contacts and which are removable from the female half for cleaning. These socket modules are held in place via a retainer. The male connector can be mated to the exposed socket end of the female socket modules via the pins. The Powell patent discloses a connector having removable sockets, not removable pins. The Powell connector is useful in dirty environments but is not particularly suited for situations where male pins are subjected to substantial wear and frequent breakage. Using the Powell connector in an underwater array, for example, would not be particularly beneficial in that the entire connector would still have to be replaced if a male pin broke.

There exists a need in the electrical connector art for an easily disassemblable electrical connector having connector pins which can be easily replaced upon damage to the same, such that the entire electrical connector or significant portion thereof does not have to be replaced and reinstalled.

SUMMARY OF THE INVENTION

The primary object of this invention is to provide a simple and easily disassemblable electrical connector having replaceable conducting pins.

Another object of this invention is to provide an electrical connector having a design which functions to allow a simplified replacement of damage susceptible parts.

Still a further object of this invention is to provide an electrical connector particularly suited for use with underwater electrical connections.

The foregoing objects are attained by the inventive electrical connector of the present invention which broadly includes a first female socket member having a socket therein and a second female socket member having a socket therein which is adapted to be in electrical connection with the first female socket member. The socket members are connected via a connector means which is configured to fit within the sockets and between the socket members. The connector means functions to physically and electrically connect the socket members. The connector means are locked in the connector via a locking means. The connector may also include a protective means disposed between the socket members which envelopes the connector means and protects the connector means from damage.

One embodiment of the connector of the present invention includes the socket means being substantially equivalent in size, shape and design and having a plurality of equivalently aligned sockets therein. The sockets are electrically connected via the connector means which may be in the form of elongated pins configured to fit within the sockets. The locking means of the pins may be comprised of a locking extension extending from the periphery of each pin wherein the extension is biased outwardly via a spring. The protective means may be a disk having cavities therein which enclose the pins and which is disposed between the socket halves.

The details of the present invention are set out in the following description and drawings wherein like reference characters depict like elements.

DETAILED DESCRIPTION OF THE PREFERRED EMBODIMENT

Figures 1, 2, 3, 4:
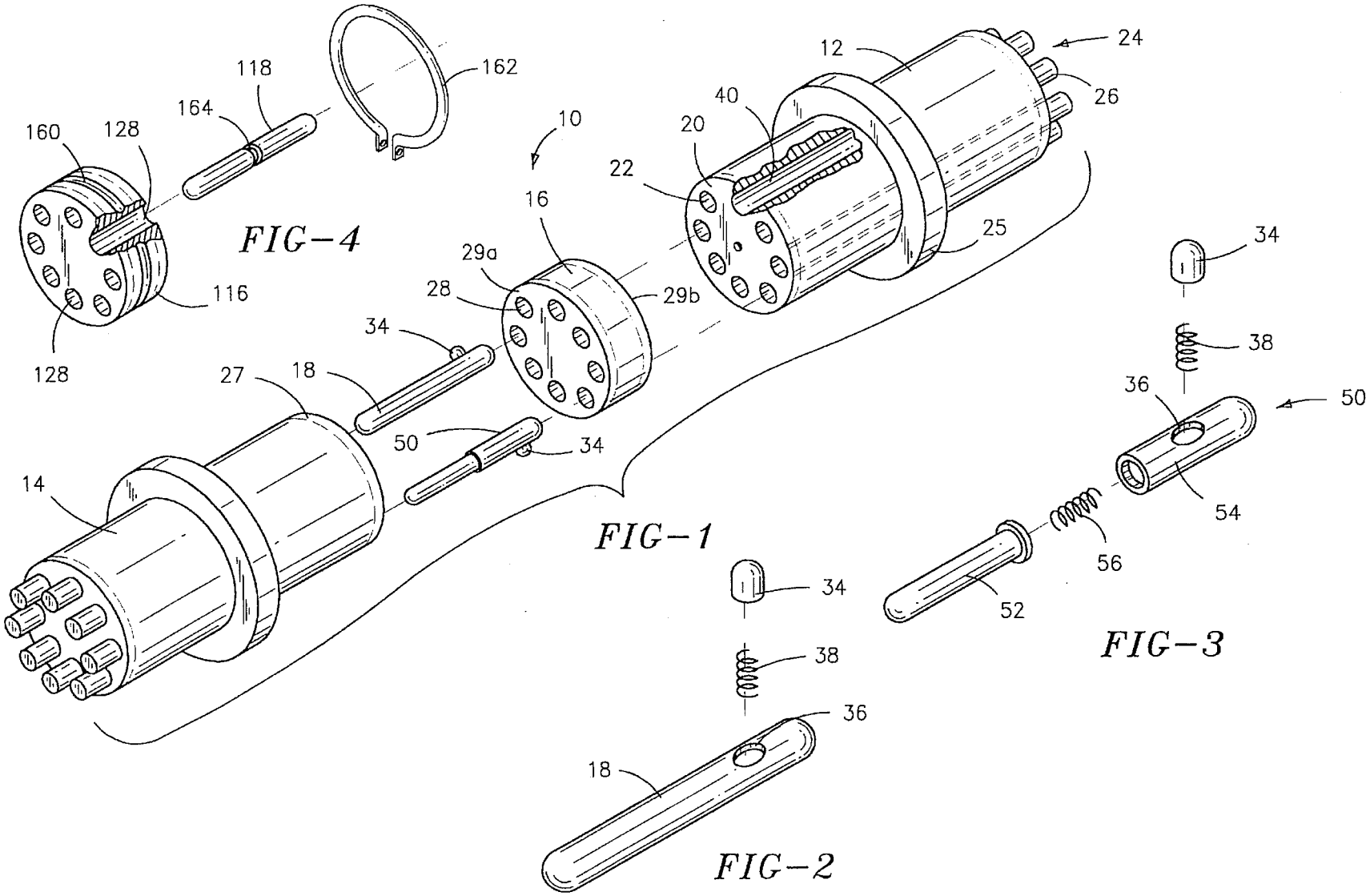
FIG. 1 is a perspective exploded view of the electrical connector in accordance with the principles of the present invention.
FIG. 2 is an enlarged perspective and exploded view of a connecting pin in accordance with the principles of the present invention.
FIG. 3 is an enlarged perspective and exploded view of a second embodiment of a connecting pin in accordance with the principles of the present invention.
FIG. 4 is a perspective and exploded view of another embodiment of the connecting pin and a protective disk.

Referring now to the drawings in detail, there is shown in FIG. 1, a perspective view of an electrical connector, designated generally as 10. Electrical connector 10 generally includes first female insert 12, second female insert 14, protective disk 16, and connecting pins 18.

Referring to FIG. 1, female inserts 12 and 14 are substantially the same and only insert 12 will be described in detail, it being understood that the description applies equally to insert 14.

Female insert 12 is essentially rod shaped and includes a socket end 20 including a plurality of sockets 22, formed from an electrically conductive material, for receiving pins 18 preferably in a close tolerance manner. Female insert 12 also includes a plug end 24 having a plurality of prongs 26 extending therefrom. Prongs 26 are in electrical communication with sockets 22 so as to facilitate the carrying of electrical transmissions between female inserts 12 and 14 to the plug ends, and onward to a cable, apparatus, monitor or other device. For ease of handling, insert 12 preferably includes a circumferential ring 25 positioned generally on the longitudinal center thereof and extending from the periphery of insert 12. Ring 25 can be grabbed for assembling or disassembling connector 10.

Each insert 12 and 14 are preferably watertight for underwater usage. The electrical connections made between inserts 12 and 14 may be surrounded by water tight seals 27 for preventing water permeation, as indicated by the dotted lines in FIG. 1. Seals 27 may be in the form of O-rings or the like which are adapted to be placed between the connecting surfaces of the inserts 12 and 14 and disk 16.

Referring still to FIG. 1, protective disk 16 is a diskshaped member formed from plastic or other non-conductive material, having a plurality of cavities 28 therethrough and two flat surfaces, 29*a* and 29*b*. Cavities 28 extend substantially perpendicular to flat surfaces 29*a* and 29*b*. Cavities 28 are essentially equal in number and diameter to the corresponding member of a plurality of sockets 22 in female inserts 12 and 14. Cavities 28 house or enclose pins 18 in part so as to provide support and protection thereto while pins 18 are installed in inserts 12 and 14. Pins 18 function to secure disk 16 between inserts 12 and 14. In order to replace a pin 18, disk 16 is removed from its location adjacent to the female inserts so that a damaged pin 18 is more easily accessible Referring now to FIGS. 1 and 2, pins 18 are essentially cigar shaped and are formed from a rigid material which is electrically conductive and preferably plated for durability. Each pin 18 has a constant and uniform diameter along its length, and is inserted into cavities 28 of disk 16 and sockets 22 of female inserts 12 and 14. Each pin 18 is long enough to extend through disk 16 and also to engage sockets 22 of inserts 12 and 14. Because sockets 22 are electrically conductive, the contact of each pin 18 with the socket is sufficient to establish electrical communication between plug end 24 and sockets 22. Each pin 18 carries electrical transmissions from one female insert 12 to the adjoined female insert 14 and onward to attached apparatuses, cables, or the like.

In another embodiment, as shown in FIG. 3, pin 50 may be spring loaded and formed from two interconnected portions having different diameters. For this embodiment, sockets 22 of insert 14 would be smaller in diameter than the sockets of insert 12, for engaging smaller diameter portion 52 of pin 50. Smaller diameter portion 52 is inserted with a spring 56 into larger diameter portion 54 and is spring loaded via spring 56 and movable relative to the larger diameter portion so as to give pin 50 resilience for assisting in avoiding breakage of the pins.

Referring to FIGS. 2 and 3, each pin 18 or 50 includes a resilient locking extension 34 extending from one end thereof. Locking extension 34 is button shaped, spring loaded and fits into a recess 36 in pin 18 or 50. A spring 38 is set into recess 36 and pushes outwardly on locking extension 34. When pin 18 is inserted into one of the set of sockets 22, locking extension 34 pushes outwardly on the inner wall 40 of socket 22, thereby locking pin 18 or 50 in the respective socket 22. Locking is established by the friction caused between extending locking extension 34 and inner wall 40 of socket 20. By pulling on pin 18 or 50 the friction can be overcome for unlocking the pin. The other end of pin 18 extends outwardly for engagement with the cavities 28 of protective disk 16 and the sockets 22 in female insert 14. Pin 18 or pin 50 functions as both a structural and an electrical connection between female inserts 12 and 14. If needed, fasteners and structure on the inserts for engaging the fasteners, such as snap rings and grooves, can be provided for structurally connecting the inserts and securing the disk therebetween. Pin 18 or 50 may also be designed to include a resilient extension on both ends for frictional locking of the pins in both inserts.

As another alternative, protective disk 16 could engage locking extension 34 of the pins. Locking extension 34 could be located on pin 18 or 50 toward the center of pin 50 so as to engage cavities 28. Accordingly, pins 18 and 50 could be locked into disk 16 instead of insert 12, or inserts 12 and 14.

As an alternative embodiment, protective disk 116 could be used to lock pins 118 into place in connector 10. As shown in FIG. 4, protective disk 116 includes a groove 160 around the center periphery thereof for engaging a non-conductive snap ring 162. Each of pins 118 have a groove 164 around the central periphery for engagement with non-conductive snap ring 162. Snap ring groove 162 extends into protective disk 116 deep enough to allow snap ring 162 to contact the peripheral groove 164 of pins 118 and lock pins 118 into cavities 128. Pins 118 may also include the locking extension shown in FIGS. 1–3 for securing the pins in sockets 22.

Figure 5:
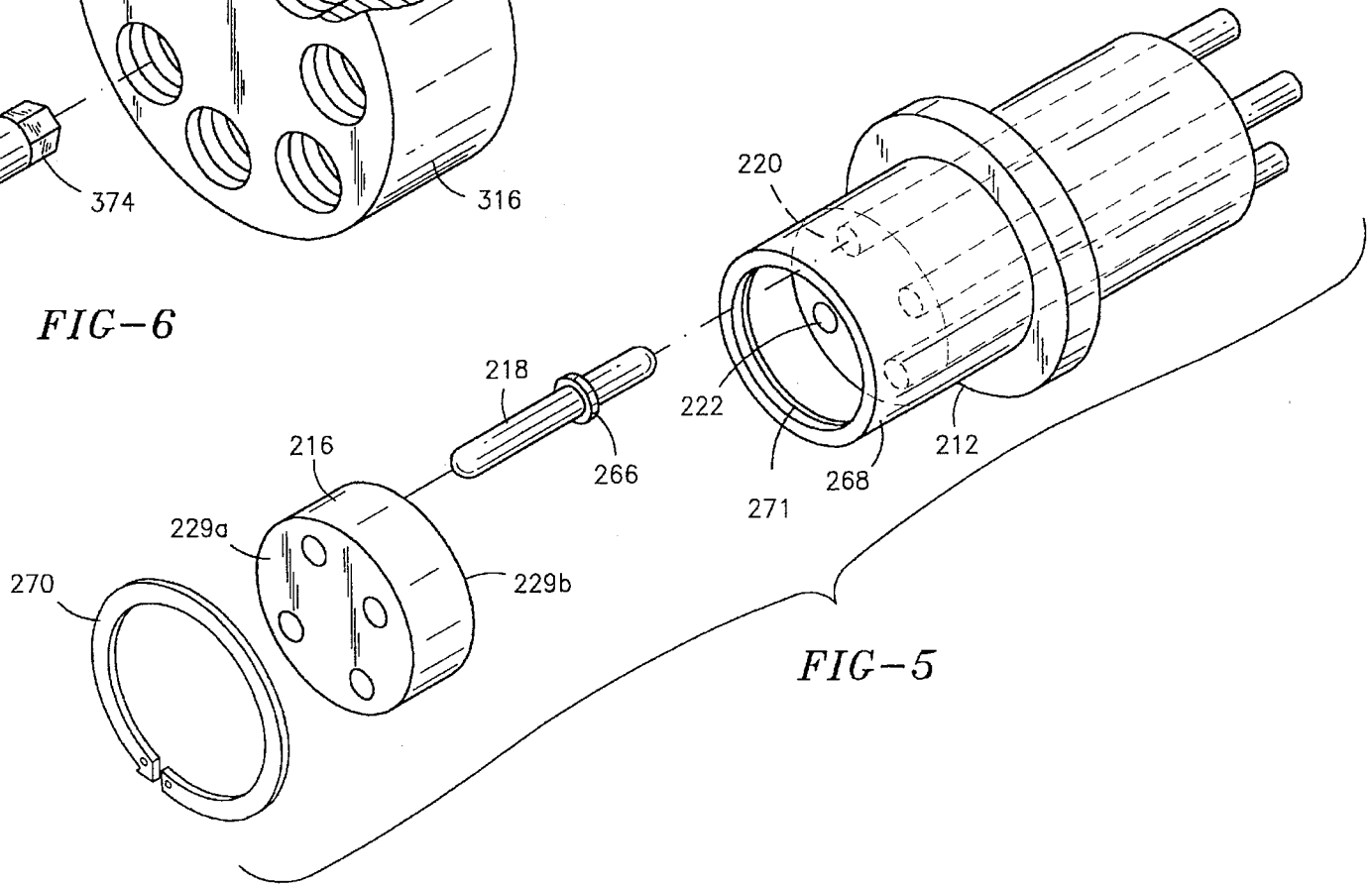
FIG. 5 is a perspective view of another embodiment of the connecting pin and female insert.

FIG. 5 is a perspective view of another embodiment of the pin and protective disk arrangement. Pin 218 is divided into two segments separated by a flange 266, wherein the segments have lengths preferably in a 2:1 ratio, although other length ratios can be used. Flange 266 is adapted to abut surface **229*b* while installed in protective disk 216. In this embodiment, protective disk 216, substantially similar to protective disk 16, is adapted to be secured to connector 212 inside cylindrical housing 268 via a non-conductive snap ring 270 which engages groove 271 while adjacent surface 229*a* of protective disk 216. Cylindrical housing 268 extends from connector 212, having an inside diameter capable of receiving the outside diameter of disk 216. Accordingly, pin 218 is secured between disk 216 and socket end 220 of connector 212, and extends into cavity 222. The other end of pin 218** then extends into the other female insert (not shown).

Figure 6:
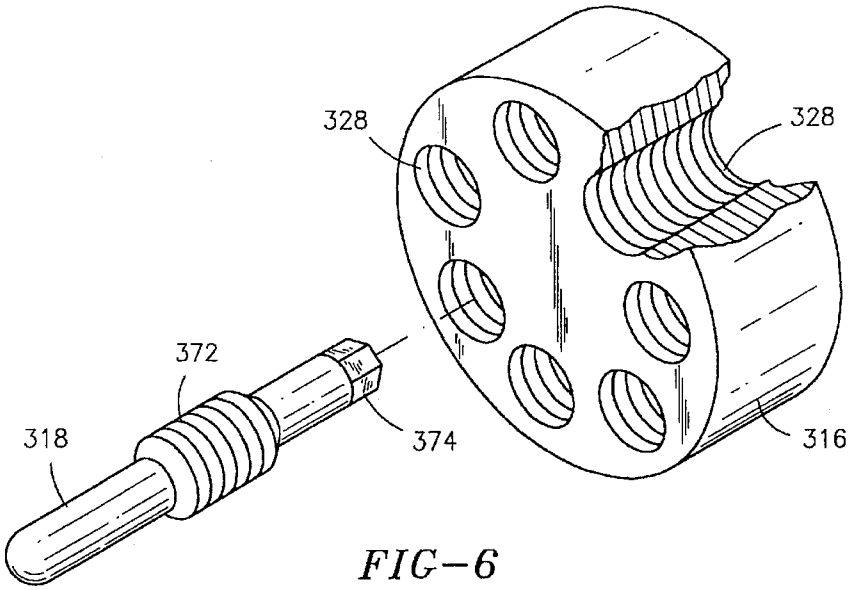
FIG. 6 is a perspective view of another embodiment of the connecting pin and protective disk.

FIG. 6 is a perspective view of another embodiment of the locking pin and protective disk. Pin 318 has a central threaded portion 372, having an outer male thread adapted to be threaded into a female threaded cavity 328 of protective disk 316. Pin 318 is secured via this threaded relationship into disk 316. Pin 318 further includes a tool engageable end 374, preferably in the form of a hex socket or head for engagement via a wrench or the like. Any such end can be used for engagement by a tool, such as, for example, a screw head for a screwdriver. It may be preferable to use the FIG. 6 pin and disk embodiment with the FIG. 5 embodiment, using cylindrical housing 268 and snap ring 270. In addition, pin 318 may also include the locking extensions shown in FIGS. 1–3 as described above.

Figures 7, 7A:
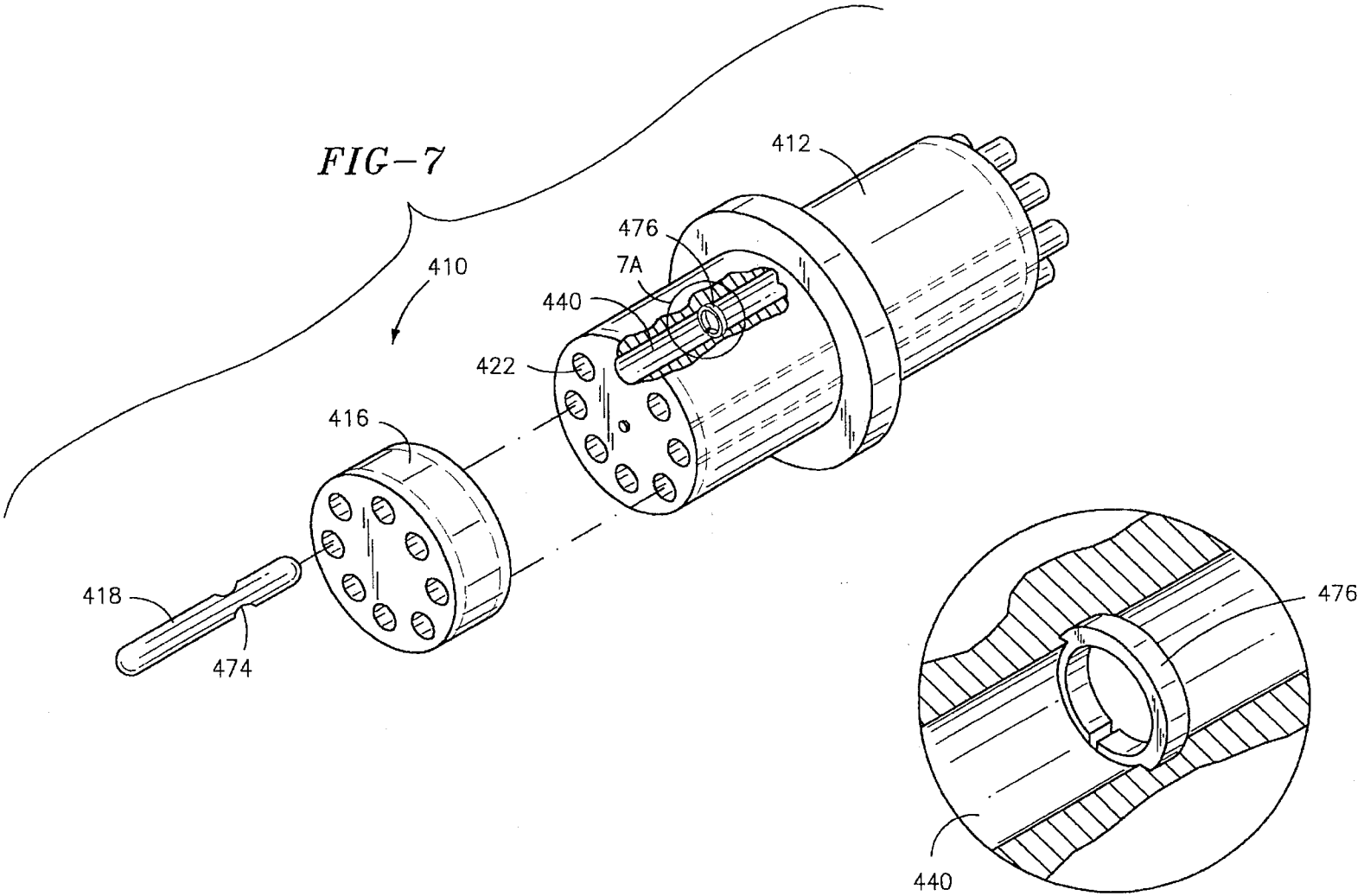
FIG. 7 is perspective view of another embodiment of the connecting pin and cavity of the female insert.
FIG. 7A is an enlarged view of the circled area of FIG. 7.

FIG. 7 is a perspective view of another embodiment of a connector 410, specifically locking pin 418 and the locking mechanism therefor. Locking pin 418 is similar to locking pin 118 and extends through protective disk 416. Locking pin 418 is preferably divided into segments, preferably having a 2:1 length ratio which is divided by a recess or chamfer 474. Pin 418 is adapted to be inserted into socket 422 wherein the inner wall 440 includes a locking ring 476, shown best in FIG. 7A, adapted to engage chamfer 474 of pin 418. Locking ring 476 is preferably in the form of a split metallic, spring loaded ring preferably having a lead in edge, not shown, which is adapted to expand and contract for engaging recess or chamfer 474, hence locking pin 418 in socket 422 of connector 412.

Any of the various pin embodiments can be used with the connector shown in FIG. 1.

In using the electrical connector, the plug ends of each female insert are connected to respective instruments or cables to be electrically connected, for example, cables of an underwater array. The pins are placed into the sockets of one of the female inserts for establishing the appropriate electrical connections between the female inserts. For example, pins 18 or 50 are pushed into the sockets 22 such that locking extensions 34 push up against inside surfaces 40 of sockets 22 of insert 12 for locking the pins therein. With the pins in place, disk 16 and then mating female insert 14 are aligned with the pins and pushed against the other female insert 12 for establishing a complete electrical connection. Each of the pins of the embodiments of FIGS. 4–7 are locked into their respective locking mechanism as described above, i.e., between the disk and insert surface; threaded into the disk; snap ring secured into the disk; and secured by the socket positioned locking ring.

If a pin should break during the course of using electrical connector 10, for example, inserts 12 and 14 are separated to partially expose pins 18 or 50. With the pins partially exposed, protective disk 16 is removed from the pins for fully exposing the broken pin for replacement. A pulling force is then applied to the pin for overcoming the friction between extension 34 and wall 40, for removing the pin. A replacement pin is then installed. The female inserts are then joined once again for re-establishing the electrical connection. In accordance with this procedure, disconnection of the entire electrical connector 10 from the underwater array, cables, monitor, apparatuses or the like, is avoided, thereby eliminating laborious connector removal procedures. The embodiments represented by FIGS. 4–7 are used in a similar manner whereas the pins thereof are removed from their respective locking mechanism for replacement. This procedure using the inventive connector is particularly suitable for underwater use where working in any capacity is difficult. As a result, time and costs are reduced while safety is increased.

The primary advantage of this invention is that a simple and easily disassemblable electrical connector is provided having replaceable conducting pins. Another advantage is that an electrical connector is provided having a design which functions to allow simplified replacement of damaged susceptible parts. Another advantage is that an electrical connector is provided which is particularly suited for use with underwater electrical connections.

It is apparent that there has been provided in accordance with this invention an electrical connector with replaceable male pins which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An electrical connector, comprising:

a first female insert including at least one socket;

a second female insert including at least one socket and adapted to be in electrical connection with said first female insert;

at least one removable connector means configured to slidably fit within said at least one socket of said first female insert and said at least one socket of said second female insert for electrically connecting said first and second female inserts;

said at least one removable connector means having a first end abutting an interior surface of said at least one socket in said first female insert and a second end mating an interior surface of said at least one socket in said second female insert so as to form said electrical connection between said first and second female inserts; and locking means for locking said at least one removeable connector means in said connector said locking means comprising a spring-biased radial retention element and a cooperating connector recess.

2. The electrical connector according to claim 1, further comprising protective means for protecting said at least one removable connector means from damage, said protective means being disposed between said first female insert and said second female insert and enveloping said at least one removable connector means.

3. The electrical connector according to claim 2, wherein said at least one removable connector means is locked into said protective means via said locking means.

4. The electrical connector according to claim 2 further comprising one of said first and second female inserts having an extended housing adapted to receive said protective disk therein and further including a snap ring positioned in a groove in said extended housing adjacent said protective disk for facilitating securement of said disk in said extended housing.

5. An electrical connector, comprising:

a first female insert including at least one socket;

a second female insert including at least one socket and adapted to be in electrical connection with said first female insert;

at least one removable connector means configured to fit within said at least one socket of said first and second female inserts for electrically connecting said first and second female inserts;

locking means for locking said connector means in said connector;

protective means for protecting said at least one connector means from damage, said protective means being disposed between said first and said second female inserts and enveloping said at least one connector means;

said protective means comprising a disk having cavities therein, at least one of said cavities adapted to enclose said at least one connector means; and said disk having a groove extending around the periphery thereof which intersects said cavities and said connector means having a groove around the periphery thereof adapted to be in alignment with said groove of said protective means, said locking means comprising a snap ring adapted to be placed into said groove of said protective means and engage said groove of said connector means for locking said connector means in said disk.

6. The electrical connector according to claim 5, wherein said connector means is at least one pin.

7. The electrical connector according to claim 1, wherein said at least one connector means is at least one pin and said locking means is a resilient extension extending outwardly beyond the periphery of said at least one pin, wherein said resilient extension is adapted to engage said at least one socket of at least one of said female inserts.

8. The electrical connector according to claim 7 wherein said at least one pin includes a recess, and said resilient extension is adapted to be compressed into said recess for facilitating the removal of said at least one pin from said socket and said at least one pin is adapted to extend outwardly from said recess for facilitating the locking of said at least one pin in said socket.

9. An electrical connector, comprising:

a first female insert including at least one socket;

a second female insert including at least one socket and adapted to be in electrical connection with said first female insert;

at least one removable connector means configured to fit within said at least one socket of said first and second female inserts for electrically connecting said first and second female inserts;

locking means for locking said connector means in said connector;

said at least one connecting means comprising at least one pin and said locking means comprising a resilient extension extending outwardly beyond the periphery of said at least one pin, said resilient extension being adapted to engage said at least one socket of said female inserts;

said at least one pin including a recess, and said resilient extension being adapted to be compressed into said recess for facilitating the removal of said at least one pin from said socket and said at least one pin being adapted to extend outwardly from said recess for facilitating the locking of said at least one pin in said socket; and said recess having a spring therein and said resilient extension being biased outwardly by said spring.

10. An electrical connector, comprising:

a first female insert including at least one socket;

a second female insert including at least one socket and adapted to be in electrical connection with said first female insert;

at least one removable connector means configured to fit within said at least one socket of said first and second female inserts for electrically connecting said first and second female inserts;

locking means for locking said connector means in said connector;

said at least one connector means comprising at least one pin and said locking means comprising a resilient extension extending outwardly beyond the periphery of said at least one pin, said resilient extension being adapted to engage said at least one socket of at least one of said female inserts; and said at least one pin further comprising a first portion slidable within a second portion, said first portion being spring loaded and compressible, causing said at least one pin to be resilient.

11. The electrical connector according to claim 2 wherein:

said first and second female inserts are substantially rod shaped having a plug end and a socket end, said plug end including a plurality of plugs and said socket end including a plurality of said sockets;

said protective means is a substantially disk shaped element having a plurality of cavities therein, said cavities adapted to envelope said connector means and protect said connector means from damage; and said connector means comprises a plurality of pins each having a diameter for engagement with said sockets and said cavities.

12. The electrical connector according to claim 11 wherein said locking means is a resilient extension extending outwardly beyond the periphery of each of said pins, each of said extensions adapted to engage at least one of said plurality of sockets.

13. The electrical connector according to claim 1 wherein said first and second female inserts each include insulation means for preventing water from permeating said connector, said insulation means allowing underwater usage of said electrical connector.

14. The electrical connector according to claim 13 wherein said insulation means comprises said female inserts having water tight seals about all electrical connections established via said electrical connector.

15. The electrical connector according to claim 2, wherein said protective means comprises a disk having cavities therein, at least one of said cavities adapted to enclose said at least one connector means.

16. The electrical connection according to claim 15 wherein said at least one connector means comprises a pin having a threaded portion and said at least one socket is threaded and adapted to engage said threaded portion.

17. The electrical connector according to claim 15 further including means for securing said protective disk in one of said first and second female inserts.

18. An electrical connection, comprising:

a first female insert including at least one socket;

a second female insert including at least one socket and adapted to be in electrical connection with said first female insert;

at least one removable connector means configured to fit within said at least one socket of said first and second female inserts for electrically connecting said first and second female inserts;

locking means for locking said connector means in said connector;

protective means for protecting said at least one connector means from damage, said protective means being disposed between said first and said second female inserts and enveloping said at least one connector means;

said protective means comprising a disk having cavities therein, at least one of said cavities adapted to enclose said at least one connector means;

said at least one connector means comprising a pin having a threaded portion and said at least one cavity being threaded and adapted to engage said threaded portion; and said pin having an end with a portion configured to be engaged by a tool, said portion being substantially non-circular.

19. An electrical connector, comprising:

a first female insert including at least one socket;

a second female insert including at least one socket and adapted to be in electrical connection with said first female insert;

at least one removable connector means configured to fit within said at least one socket of said first and second female inserts for electrically connecting said first and second female inserts;

locking means for locking said connector means in said connector;

protective means for protecting said at least one connector means from damage, said protective means being disposed between said first and said second female inserts and enveloping said at least one connector means;

said locking means comprising each socket in one of said inserts having means therein for securely engaging said at least one connector means; and said means for securely engaging comprising a spring loaded ring and said at least one connector means comprising a pin having a recess for engagement with said spring loaded ring.

* * * * *